US008137805B2

(12) United States Patent
Sebright

(10) Patent No.: US 8,137,805 B2
(45) Date of Patent: Mar. 20, 2012

(54) MANGANESE BASED COATING FOR WEAR AND CORROSION RESISTANCE

(75) Inventor: Beth Ann Sebright, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 557 days.

(21) Appl. No.: 12/213,082

(22) Filed: Jun. 13, 2008

(65) Prior Publication Data

US 2008/0318035 A1 Dec. 25, 2008

Related U.S. Application Data

(60) Provisional application No. 60/929,323, filed on Jun. 21, 2007.

(51) Int. Cl.
*B32B 15/04* (2006.01)
*B32B 7/00* (2006.01)
*B05D 3/02* (2006.01)

(52) U.S. Cl. ..... 428/336; 428/472; 428/469; 428/372; 428/701; 428/702; 416/241 R; 416/241 B

(58) Field of Classification Search ..... None
See application file for complete search history.

(56) References Cited

U.S. PATENT DOCUMENTS

| | | | | | |
|---|---|---|---|---|---|
| 2,866,728 | A | | 12/1958 | Warinner | |
| 2,901,385 | A | * | 8/1959 | Curtin | 428/470 |
| 3,634,145 | A | | 1/1972 | Homan | |
| 3,652,463 | A | * | 3/1972 | Riddel | 252/519.5 |
| 3,761,293 | A | * | 9/1973 | Carini et al. | 501/16 |
| 3,868,280 | A | * | 2/1975 | Yamamoto et al. | 148/113 |
| 3,999,040 | A | * | 12/1976 | Ellis | 219/543 |
| 4,064,074 | A | * | 12/1977 | Ellis | 252/506 |
| 4,673,444 | A | | 6/1987 | Saito et al. | |
| 4,681,641 | A | | 7/1987 | Zurilla et al. | |
| 5,238,506 | A | | 8/1993 | Cape et al. | |
| 5,604,040 | A | | 2/1997 | Sugama | |
| 5,904,786 | A | | 5/1999 | Wendel et al. | |
| 6,001,494 | A | * | 12/1999 | Kuchinski et al. | 428/653 |
| 6,074,464 | A | | 6/2000 | Eddinger et al. | |
| 6,322,906 | B1 | | 11/2001 | Nakakoji et al. | |
| 6,342,107 | B1 | | 1/2002 | Miyamoto et al. | |
| 6,368,426 | B1 | | 4/2002 | Sienkowski et al. | |
| 6,497,772 | B1 | | 12/2002 | Meckel et al. | |
| 6,551,417 | B1 | | 4/2003 | Rodzewich et al. | |
| 6,620,263 | B1 | | 9/2003 | Sienkowski | |
| 6,794,086 | B2 | * | 9/2004 | Dai et al. | 429/231.95 |
| 6,835,460 | B2 | | 12/2004 | Cuyler et al. | |
| 6,926,997 | B2 | * | 8/2005 | Guidotti et al. | 429/218.1 |
| 7,491,469 | B2 | * | 2/2009 | Guidotti et al. | 429/221 |
| 2002/0122942 | A1 | * | 9/2002 | Aichele et al. | 428/403 |

(Continued)

OTHER PUBLICATIONS

Fuel Cell Handbook, Fifth Edition, Oct. 2000, Business/Technoloy Books, Orinda, Ca. p. 1-1.*

*Primary Examiner* — Jennifer McNeil
*Assistant Examiner* — Vera Katz
(74) *Attorney, Agent, or Firm* — Finnegan, Henderson, Farabow, Garrett & Dunner LLP

(57) ABSTRACT

A component is disclosed. The component includes a substrate made of a ferrous metal, and a coating on a surface of the substrate. The coating includes a compound having an empirical formula $Fe_xMn_yO_z$, where x varies from about 0 to about 2, y varies from about 1 to about 4, and z varies from about 2 to about 8.

20 Claims, 3 Drawing Sheets

U.S. PATENT DOCUMENTS

2003/0056520 A1* 3/2003 Campbell et al. ..... 60/777
2003/0103875 A1* 6/2003 Campbell et al. ..... 422/177
2004/0031692 A1* 2/2004 Hardee ..... 205/118
2006/0199063 A1* 9/2006 Miura et al. ..... 429/33
2009/0209415 A1* 8/2009 Kayama et al. ..... 502/303

* cited by examiner

MANGANESE BASED COATING FOR WEAR AND CORROSION RESISTANCE

CROSS REFERENCE TO RELATED APPLICATIONS

This application is based upon and claims the benefit of priority from U.S. Provisional Application No. 60/929,323 to Sebright filed on Jun. 21, 2007.

TECHNICAL FIELD

The present disclosure relates generally to a manganese based coating, and more particularly, to a manganese based coating for wear and corrosion resistance.

BACKGROUND

Components are sometimes coated with a material to locally modify the properties of the component. Coating the external surfaces of a component with a material is called surface coating. Surface coating of a component to improve surface properties saves money and time since desirable properties can be achieved without having to fabricate the component with a different material. For example, easy availability, low cost, and good pour qualities make cast iron a desirable material for cast engine components. However, cast iron components used in a corrosive environment may be susceptible to corrosion. The ability to coat the surfaces of the component with a corrosion resistant material may increase the corrosion resistance of the component without sacrificing the beneficial properties of cast iron. Surface coatings have been extensively used in industry to impart beneficial properties to components.

An especially difficult environment to provide protection for a metal substrate is one which combines a high temperature corrosive ambient with wear, as seen in turbocharger housings and exhaust components of internal combustion engines. Surface coatings of metal carbide or metal nitride, such as titanium carbide (TiC), titanium nitride (TiN), or chrome nitride (CrN, $Cr_2N$), are sometimes used to provide abrasion and corrosion resistance for components in these extreme environments. Typically, these coatings are applied by ion coating processes, such as physical vapor deposition (PVD), chemical vapor deposition (CVD), or by means of a galvanic coating process. It has been observed that the CrN, $Cr_2N$, TiN or TiC coatings have a tendency to peel off over time and may need to be reapplied. Although these metal nitrides and metal carbide coatings may be reapplied, it may be advantageous to use a more durable coating material that would last a longer time. Additionally, in the case of some components, the reapplication processes of these coatings may be cumbersome.

Another type of surface coating used in industry to increase corrosion and wear resistance of metal components are conversion coatings. Conversion coatings are surface coatings where the part of the metal surface is converted into the coating with a chemical or electrochemical process. Examples include chromate conversion coatings, and phosphate conversion coatings. Phosphate conversion coating treatments (called "phosphating") provide a coating of insoluble metal-phosphate crystals that adhere strongly to the base metal. Typically, these phosphating treatments are applied to a metal surface before painting. Generally, phosphating solutions are prepared from liquid concentrations containing one or more divalent metals, free phosphoric acid, and an accelerator. The phosphating process consists of a series of application and rinse stages typically involving the application of either an iron, or zinc phosphate solution to a substrate. A simple iron phosphating system is composed of two stages: an iron phosphate bath that both cleans the part and applies the conversion coating followed by a rinse bath to remove dissolved salts from the treated surface. Following the conversion application, the components may be dried.

Although the application process of conversion coatings may be suitable for reapplication, the wear and corrosion protection offered by these coatings may not be significant. Therefore, a surface coating for a metal substrate that provides good corrosion and wear resistance that can be applied using a process suitable for reapplication may be desired.

SUMMARY OF THE INVENTION

In one aspect, a component is disclosed. The component includes a substrate made of a ferrous metal, and a coating on a surface of the substrate. The coating includes a compound having an empirical formula $Fe_xMn_yO_z$, where x varies from about 0 to about 2, y varies from about 1 to about 4, and z varies from about 2 to about 8.

In another aspect, a method of coating a component is disclosed. The method includes preparing a surface of the component for coating, and dipping the component in a coating solution. The method also includes heat curing the dipped component at high temperature to produce a coating having an empirical formula $Fe_xMn_yO_z$, where x varies from about 0 to about 2, y varies from about 1 to about 4, and z varies from about 2 to about 8.

In yet another aspect, an engine system is disclosed. The engine system includes a power source, an air induction system, an exhaust system, and a component of at least one of the power source, the air induction system and the exhaust system. The component includes a ferrous substrate with a coating having an empirical formula of $Fe_xMn_yO_z$, where x varies from about 0 to about 2, y varies from about 1 to about 4, and z varies from about 2 to about 8.

DETAILED DESCRIPTION

Figure 1:
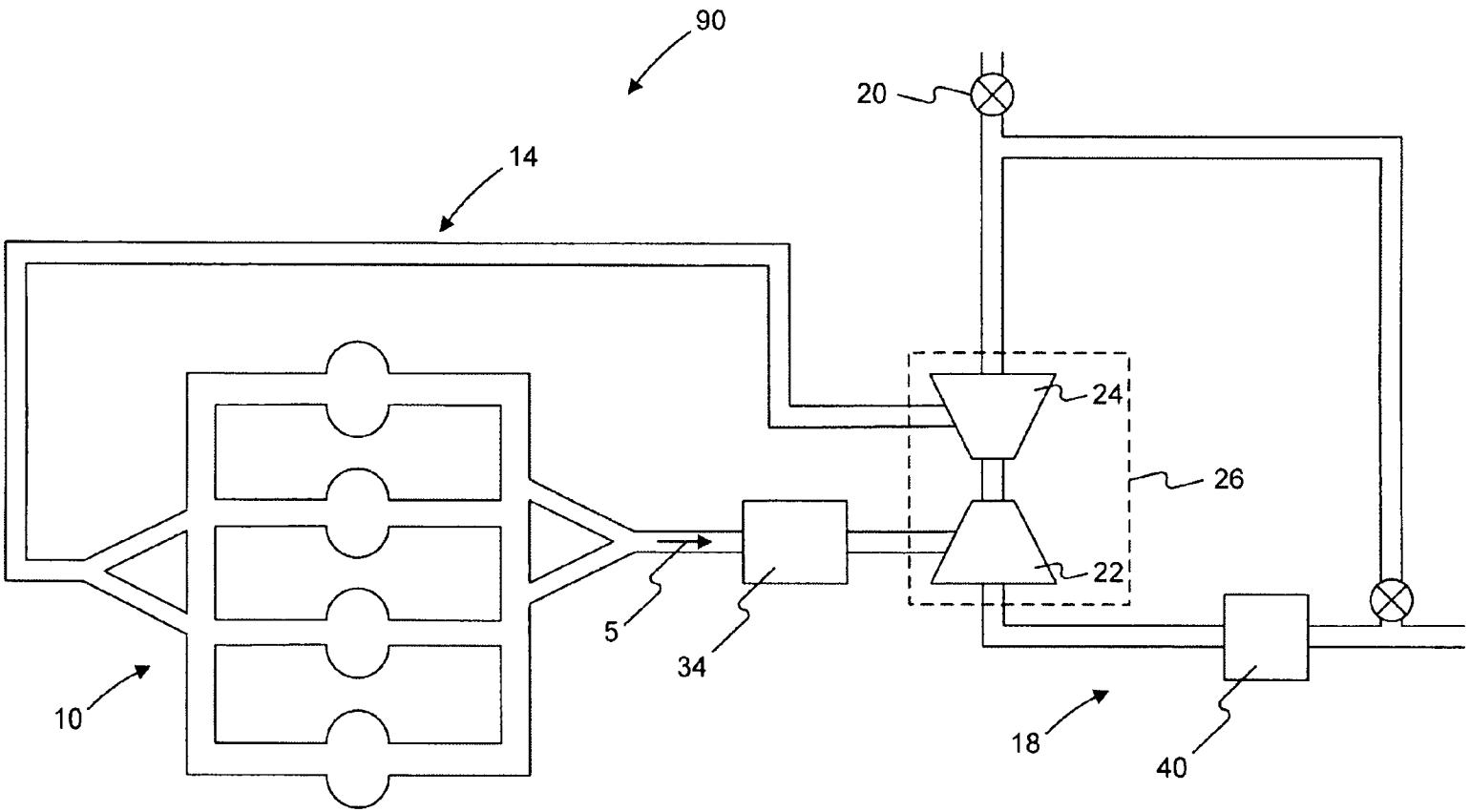
FIG. 1 is an illustration of an exemplary disclosed engine system.

FIG. 1 illustrates an engine system 90. Engine system 90 may have, among other systems, a power source 10, and an air induction system 14, and an exhaust system 18. Power source 10 may include an engine such as, for example, a diesel engine, a gasoline engine, a natural gas engine, or any other engine apparent to one skilled in the art. Fuel may be combusted in power source 10 to produce mechanical power. Combustion of the fuel may produce exhaust gases 5. These exhaust gases 5 may be exhausted to the atmosphere through the exhaust system 18.

Air induction system 14 may be configured to introduce compressed air into a combustion chamber (not shown) of power source 10. Air induction system 14 may include components configured to provide compressed air into the power source. These components may include any components known in the art such as, valve 20, air coolers, additional valves, air cleaners, control system, etc.

Exhaust system 18 may be configured to direct exhaust gases 5 out of power source 10. Exhaust gases 5 may be hot and contain solid particulate matter and various chemicals in liquid or gaseous form (hereinafter called "chemical species"). Some of these chemical species may be regulated by regulatory agencies, and hence may need to be removed before exhaust gases 5 are released into the atmosphere. Exhaust system 18 may include components that may be configured to separate these chemical species from exhaust gases 5. These components may include, among others, a first particulate filter 34, and a second particulate filter 40. Exhaust system 18 may also include components that are configured to extract power from exhaust gases 5. These components may include a turbocharger 26.

The turbocharger 26 may consist of a turbine 22 connected to a compressor 24 by a shaft. The turbine 22 may receive exhaust gases 5 from the power source 10 causing a turbine wheel to rotate. This rotation may drive the compressor 24, compressing air in air induction system 14. In some embodiments, a portion of the exhaust gases 5 may be mixed with ambient air being compressed in compressor 24.

The chemical species contained in exhaust gases 5 may include, among others, ash of metallic salts (hereinafter "ash") produced due to the combustion of impurities, such as sulphur, vanadium, sodium, potassium, and other metals, present in the fuel. These and other chemical species may impinge on the metallic surfaces of turbine 22 of turbocharger 26 and cause wear. Some of these impinging materials may also adhere to the turbine surfaces. These adhering chemical species may be corrosive and may corrode the metallic surfaces of turbine 22 over time. The corrosivity of the chemical species may increase with the temperature of exhaust gases 5 and the makeup of the chemical species. A coating may be provided on the walls of turbine 22 (and other components of turbocharger 26) to improve the corrosion resistance and wear resistance of these surfaces.

Figure 2A:
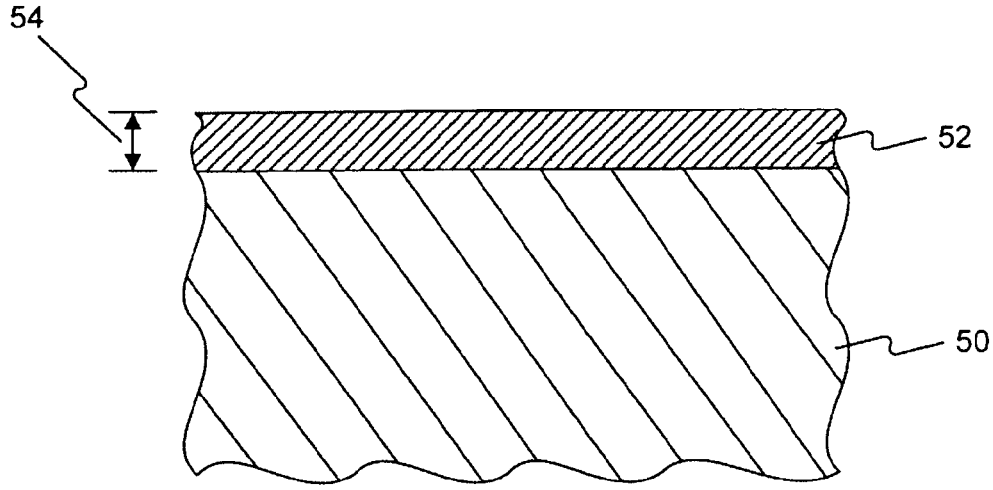
FIG. 2A is an illustration of an embodiment of a coating on a component of the engine system of FIG. 1.

FIG. 2A illustrates a wall of the turbocharger 26 of FIG. 1. The turbocharger wall may include a substrate 50 and a coating 52 on the surface thereof. The substrate 50 may be made of any metallic material. In some embodiments, the substrate 50 may be a ferrous material, such as a steel alloy or cast iron. Although substrate 50 is depicted as planar in FIG. 2, substrate 50 can include curved surfaces and generally be of any shape.

Coating 52 may be a conformal coating on the surface of substrate 50. In this disclosure, a conformal coating refers to a coating that substantially conforms to the shape of an underlying substrate. A conformal coating may generally resemble the shape of the substrate it is applied on. However, it is contemplated that a conformal coating may not cover some sharp discontinuities of the substrate surface, including crevices, points, pores, cracks, sharp edges, and internal surfaces.

Coating 52 may have a thickness 54 between about 5 microns and about 10 microns. In some embodiments, thickness 54 of coating 52 over substrate 50 may be substantially uniform. However, it is contemplated that in some embodiments, thickness 54 of coating 52 may vary over the substrate surface. In these embodiments, thickness 54 may vary between about 5 microns and about 10 microns. That is, a minimum coating thickness may be about 5 microns and a maximum coating thickness may be about 10 microns. In the described turbocharger application, coating thickness 54 below about 5 microns may not provide the necessary corrosion and wear resistance, and coating thickness significantly above about 10 microns may exceed allowable dimensional margins. However, it is contemplated that for other applications, thickness 54 of coating 52 may have other values, including thickness 54 below about 5 microns and above about 10 microns.

Coating 52 may be substantially made of one or more compounds having an empirical formula $Fe_xMn_yO_z$, where x may vary from about 0 to about 2, y may vary from about 1 to about 4, and z may vary from about 2 to about 8. For example, coating 52 may be made of compounds having the empirical formula $FeMnO_4$, $FeMnO_2$, $MnO_2$, $Fe_2MnO_4$, etc. An empirical formula is a formula that indicates the relative proportions of the atoms in a molecule rather than the actual number of atoms of the elements. For instance, a chemical formula $Fe_5Mn_8O_{20}$ for a compound may indicate that a molecule of the compound may have 5 atoms of Fe, 8 atoms of Mn and 20 atoms of 0. The same compound may also be expressed by an empirical formula of $Fe_1Mn_{1.6}O_4$ (that is, $Fe_{5/5}Mn_{8/5}O_{20/5}$). In some embodiments, coating 52 may be substantially made up of the same material. In other embodiments, coating 52 may include multiple materials all following the empirical formula $Fe_xMn_yO_z$. That is, in some embodiments, one region of coating 52 may be substantially made of $FeMnO_4$ (for example, adjacent to substrate 50) while another region may be made of $MnO_4$ (for example, near the surface).

Figure 2B:
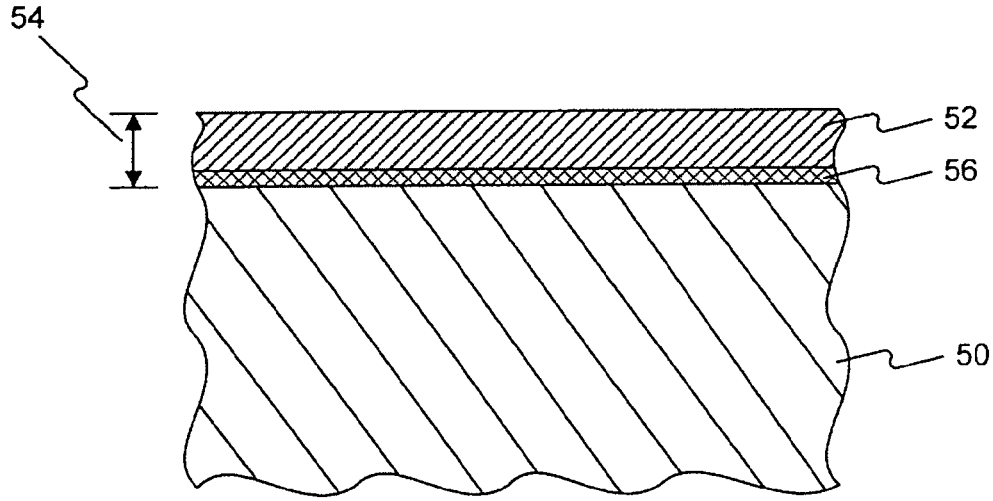
FIG. 2B is an illustration of another embodiment of a coating on a component of the engine system of FIG. 1.

It is also contemplated that in some embodiments, as illustrated in FIG. 2B, an adhesion layer 56 may be present between substrate 50 and coating 52. Adhesion layer 56 may be made of a material that may improve the adhesion of coating 52 on substrate 50. In some embodiments, adhesion layer 56 may be remnants of a material used to improve the surface wettability or adhesion of coating 52 on substrate 50. In some embodiments, adhesion layer 56 may be made of a phosphate material. However, adhesion layer 56 made of any material that improves the adhesion and/or surface wettability of coating 52 on surface 50 are also contemplated.

Figure 3:
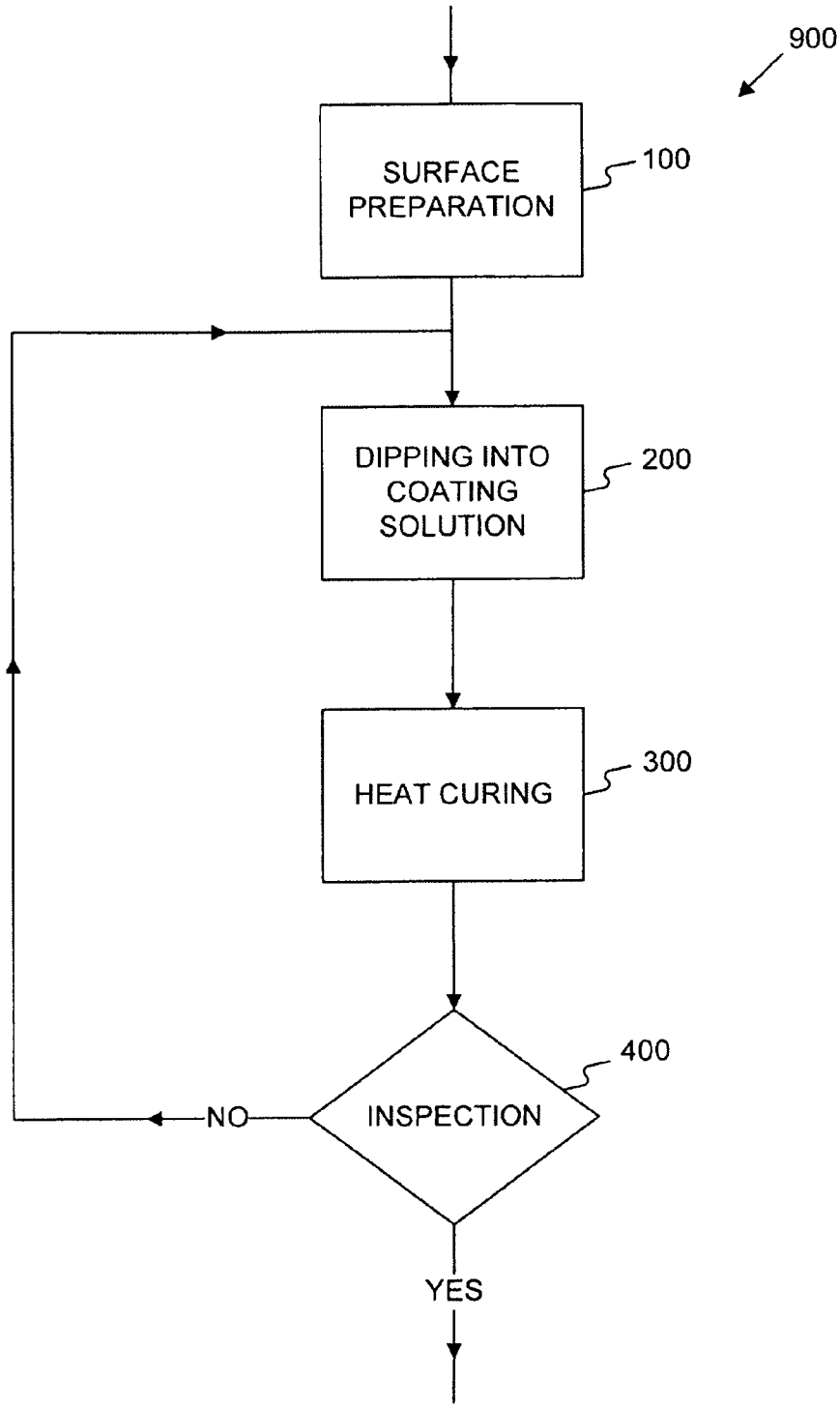
FIG. 3 is an illustration of an exemplary method of making an embodiment of the coating of FIG. 2A-2B.

FIG. 3 illustrates an exemplary method 900 of applying the coating of FIGS. 2A and 2B. Coating 52 may be made on substrate 50 of a component of turbocharger 26. Substrate 50 may be may be a newly fabricated component, or may be a used component that is being remanufactured. A remanufactured component may be a component that has been previously used in engine system 90. Coating 52 in the remanufactured component may be worn and may, therefore, need to be re-coated.

The substrate 50 may be prepared for coating in the surface preparation step 100. Surface preparation step 100 may include any operation configured to clean and prepare the surface of substrate 50 for coating 50. The surface of substrate 50 may be cleaned of any rust, debris, or other organic contaminants (hereinafter referred to as "contaminants"). For components being remanufactured, these contaminants may also include remnants of the previous coating. In these embodiments, surface preparation step 100 may remove all or part of the worn coating from substrate 50. Surface preparation step 100 may include mechanical cleaning, chemical-assisted cleaning, chemical stripping, and/or abrasive blasting.

Mechanical cleaning may include scrubbing (sanding, brushing, etc.) contaminants off substrate 50. Solvents may also be used to assist in the cleaning operation. These solvents may remove contaminates such as oils and greases. Surface preparation step 100 may include various solvents and solvent-based methods to clean substrate 50. For example, substrate 50 may be immersed in a solvent tank, solvents may be wiped or sprayed onto substrate 50, or solvent vapor degreasing units may also be used. Sometimes a combination of techniques may be used to clean the substrate. For example, substrate 50 may be immersed in a solvent tank or sprayed with a solvent followed by mechanical brushing.

Chemical stripping may include applying solvents to the surface to soften or dissolve the contaminants. The solvents soften or dissolve the contaminants that are then scraped away or otherwise mechanically removed. Substrate 50 may then be rinsed with water to remove the solvent from the surface. Solvents used in surface preparation step 100 may be hot or cold. Hot solvents may include sodium hydroxide and other organic additives. Cold solvents may include alcohols and may be formulated with methylene chloride and other additives such as phenolic acids, cosolvents, water-soluble solvents, thickeners, and sealants. Solvents may also include formulations of N-methyl-2-pyrollidone (NMP) and dibasic esters (DBE).

Abrasive blasting may include forcibly propelling a stream of abrasive particles on the surface of substrate 50. These high speed particles remove contaminants from the surface. The abrasive particles used may include steel grit, alumina, garnet, and glass beads. These abrasives may create a rough surface profile on substrate 50 which may aids coating adhesion.

After the contaminants are removed from the surface of the component, the component may, in some embodiments, be rinsed and dried. The component may then be dipped into the coating solution 200. The coating solution may include an aqueous solution of a permanganate and an acidic metal phosphate solution in water. Permanganates are salts of permanganic acid, such as potassium permanganate ($KMnO_4$) and sodium permanganate ($NaMnO_4$). The permanganate may contain the permanganate ion ($MnO_4$—). Because manganese (Mn) is in the +7 oxidation state, the permanganate ion may be a strong oxidizer. The acidic metal phosphate solution may be formed by the dissolution of a primary metal salt in phosphoric acid. The metal salt dissolved in the phosphoric acid salts such as zinc oxide, manganese oxide, aluminum oxide, etc. Exemplary phosphate solutions may include one or more of sodium hemiphosphate; sodium dihydrogen phosphate monohydrate; sodium dihydrogen phosphate dihydrate; sodium dihydrogen phosphate compound with disodium hydrogen phosphate (MSP-DSP); disodium hydrogen phosphate dihydrate; disodium hydrogen phosphate heptahydrate; disodium hydrogen phosphate octahydrate; disodium hydrogen phosphate dodecahydrate; trisodium phosphate hemihydrate; trisodium phosphate hexahydrate; trisodium phosphate octahydrate; trisodium phosphate dodecahydrate; monopotassium phosphate; dipotassium phosphate; dipotassium hydrogen phosphate trihydrate; dipotassium hydrogen phosphate hexahydrate; tripotassium phosphate; tripotassium phosphate trihydrate; tripotassium phosphate heptahydrate; tripotassium phosphate nonahydrate; calcium hydrogen phosphate; calcium hydrogen phosphate hemihydrate; calcium hydrogen phosphate dihydrate; aluminum dihydrogen phosphate; aluminum dihydrogen tripolyphosphate; aluminum phosphate dihydrate; monoaluminum phosphate sesquihydrate; dialuminum phosphate trihydrate; poly (aluminum metaphosphate); monoiron(III) phosphate; trimagnesium phosphate octahydrate; aluminum hemiphosphate; etc.

For an embodiment of the coating solution having potassium permanganate and aluminum dihydrogen phosphate in water, the concentration of the constituents may be about 4 gms (grams) to about 12 gms of potassium permanganate to about 1 ml (milliliters) to about 5 ml of aluminum dihydrogen phosphate ($AlH_2PO_4$) in about 150 ml of water. Ions such as $MnO_4^-$, $K^+$, $Al^{x+}$, $H^+$, $PO_4^{3-}$ may exist in such a coating solution. When the component is dipped into the coating solution, the coating solution may wet the surfaces of the component (form a thin layer on the surface of the component). Redox reactions (reduction/oxidation) may also begin to take place on the surface of the component.

After the component is dipped in the dipping solution (step 200) to form a thin layer of coating solution on the component surface, the component may be heat cured 300. Any known process may be used to heat cure the component. During heat curing, the component may be soaked at a high temperature for about 1 to about 10 minutes. At this temperature, the redox reactions on the component surface may speed up. The $PO_4^{3-}$ ions in the thin layer of coating solution may attack the substrate surface liberating iron ions (Fe). Electron exchange may occur between these liberated Fe ions and $MnO_4^-$ or $H^+$ ions in the coating solution to form coating 52 on the surface of the component. Depending upon the concentrations of the individual components in the coating solution and the reaction conditions, the coating 52 formed on the component surface may include a mixed oxide of iron and manganese. In some embodiments, a thin adhesion layer 56 may also be formed between substrate 50 and coating 52. The adhesion layer 56 may include a phosphate compound formed by a reaction of the $PO_4^{3-}$ ions of the coating solution.

In some embodiments, the component may be heat cured in a heat curing oven maintained at a temperature higher than or equal to about 540° C. The heat curing temperature and soaking time may depend upon the coating solution used and the size of the component. In some embodiments, depending upon the coating solution used, phase transformation, where $MnO_4$ transforms to the more stable $MnO_2$ oxidation state, may occur at about 540° C. In these embodiments, a large component may have to be kept in the heat curing oven for increased time and/or higher temperature to ensure that every region of the component surface reaches 540° C. In some embodiments, heat curing may be performed at other temperatures, even below 540° C.

In some embodiments, other processes may be used to heat cure the component. For example, in a production setting a high through-put heat curing process, such as induction coil, may be used to heat cure the component. An induction coil may heat the component by an induction heating process. Induction heating is the process of heating a metal object by electromagnetic induction, where eddy currents are generated within the metallic substrate, and resulting resistance leads to Joule heating of the substrate.

After heat curing, coating 52 on the surface of substrate 50 may be inspected in the inspection step 400. Inspection step 400 may include automated, manual, or semi-automated inspection. In some applications, thickness 54 of the coating may be measured during the inspection step 400. If the thickness 54 is below the desired value, the component may be again subject to the dipping and heat curing steps (steps 200 and 300). In these embodiments, the component may be repeatedly dipped and heat cured until thickness 54 of coating 52 is the desired value. In some embodiments, the inspection step 400 may be eliminated. In these embodiments, prior experience or experimentation may indicate the number of dipping and heat curing steps needed to achieve a desired thickness of coating. In these embodiments, the component may be subject to several sequential dipping and heat curing steps to produce coating 52 of a desired thickness 54.

Although the description above illustrates a coating on a surface of a turbocharger component, coating 52 can be applied to any ferrous substrate where corrosion resistance and/or wear resistance is desired. For example, coating 52 may be applied on a ferrous substrate of an exhaust manifold of an engine or a gas turbine engine component. The term corrosion is used in a broad sense in this disclosure. For instance, any interaction between the substrate and its environment that results in a degradation of the physical, mechanical, or aesthetic properties of the substrate is corrosion of the substrate.

INDUSTRIAL APPLICABILITY

The disclosed manganese based coating may improve the corrosion and wear resistance of metallic components. A manganese based conversion coating is applied to the surface of the component using dip and dry processes. The surface of the component is first cleaned to remove dust, debris, organic residues, and remnants of a prior coating (in the case where the component was previously coated) using surface preparation processes. The component may then be dipped in a coating solution containing a mixture of an aqueous solution of a permanganate and an acidic metal phosphate solution in water. The dipped component is then heat cured at a temperature higher than or equal to about 540° C. for about 1 to about 10 minutes to form a coating of $Fe_xMn_yO_z$ ($x \approx 0$ to 2, $y \approx 1$ to 4, $z \approx 2$ to 8) on the surface of the component. The component may be subject to several dipping and heat curing steps to achieve a coating thickness from about 5 microns to about 10 microns. To illustrate an application of the manganese based coating, an exemplary embodiment will now be described.

A housing component of turbocharger 26 of engine system 90 is removed from the engine and cleaned to remove dirt and organic residues adhering to the component surface. The component is doused with acetone and scrubbed with a mechanical scrubber to clean loose dirt and organic debris off the surface of the component. The component surface is then cleaned using abrasive blasting to remove rust and remnants of a prior coating on the housing surface. A stream of glass beads emanating from a nozzle of a wand is run over the surface of the component for about a minute. The component is then cleaned in water and dried. A coating of solution of about 10 gms of potassium permanganate is mixed with about 2 ml of aluminum dihydrogen phosphate and about 150 ml of water. The cleaned component is then dipped into the coating solution for a few seconds. The dipped component is then transferred to an oven set at a temperature of about 600° C. The component is kept in the oven for about 2 to 3 minutes to ensure that the entire component surface is at or above a temperature of about 540° C. The component is then removed from the oven and cooled. The cooled component is again dipped in the coating solution and heat cured in the oven two more times to get a mixed iron and manganese oxide coating 52 having thickness 54 of about 7 microns. The coating may include a mixture of $FeMnO_4$, $FeMnO_2$, $Fe_2MnO_4$, and $MnO_2$.

The $Fe_xMn_yO_z$ ($x \approx 0$ to 2, $y \approx 1$ to 4, $z \approx 2$ to 8) coating on the component surface may provide sufficient corrosion and wear resistance to the surface to enable the component to be used in a corrosive environment. The dipping and heat curing coating process to apply the coating on the component surface may also enable easy reapplication of the coating to components where a prior coating has worn off.

It will be apparent to those skilled in the art that various modifications and variations can be made to the disclosed manganese based coating for wear and corrosion resistance. Other embodiments will be apparent to those skilled in the art from consideration of the specification and practice of the disclosed manganese based coating. It is intended that the specification and examples be considered as exemplary only, with a true scope being indicated by the following claims and their equivalents.

What is claimed is:

1. A component for an exhaust system of an internal combustion engine comprising:

a substrate positioned to be exposed to exhaust gases produced by the engine, the substrate being made of a ferrous metal; and a conversion coating formed on a surface of the substrate by chemically converting a portion of the surface, the coating including a compound having an empirical formula $Fe_xMn_yO_z$, where x varies from about 0 to about 2, y varies from about 1 to about 4, and z varies from about 2 to about 8, wherein the empirical formula of the coating varies within the coating.

2. The component of claim 1, wherein x varies from about 1 to about 2, y varies from about 1 to about 4, and z varies from about 2 to about 8.

3. The component of claim 1, wherein the coating includes one or more compounds having the empirical formula $Fe_xMn_yO_z$, where x varies from about 0 to about 2, y varies from about 1 to about 4, and z varies from about 2 to about 8.

4. The component of claim 3, wherein the empirical formula of the coating in the region adjacent to the substrate is $FeMnO_4$ and the empirical formula in the region adjacent to the surface of the coating is $MnO_4$.

5. The component of claim 1, including a second coating between the substrate and the coating.

6. The component of claim 1, wherein a thickness of the coating is between about 5 microns and about 10 microns.

7. The component of claim 6, wherein the thickness of the coating is substantially uniform over the substrate.

8. The component of claim 1, wherein the component is a remanufactured component.

9. The component of claim 1, wherein the empirical formula of the region of the coating adjacent to the substrate includes $FeMnO_4$.

10. An engine system comprising:

a power source;

an air induction system;

an exhaust system; and a component of at least one of the power source, the air induction system and the exhaust system, the component including a ferrous substrate having a conversion coating thereon, the coating being formed by chemically converting a portion of the substrate to the coating, the coating having an empirical formula of $Fe_xMn_yO_z$, where x varies from about 0 to about 2, y varies from about 1 to about 4, and z varies from about 2 to about 8, wherein the empirical formula varies within the coating.

11. The engine system of claim 10, wherein a thickness of the coating is from about 5 microns to about 10 microns.

12. The engine system of claim 10, wherein the substrate further includes a second coating below the coating.

13. The engine system of claim 10, wherein the empirical formula in the region of the coating adjacent to the substrate is $FeMnO_4$.

14. The engine system of claim 10, wherein the coating is a conformal coating.

15. The engine system of claim 10, wherein a thickness of the coating is substantially uniform over the substrate.

16. The engine system of claim 10, wherein the empirical formula of the coating in the region adjacent to the substrate is $FeMnO_4$ and the empirical formula in the region adjacent to the surface of the coating is $MnO_4$.

17. An engine component configured to be subject to corrosion and wear, comprising:

a ferrous substrate; and a conversion coating having an empirical formula of $Fe_xMn_yO_z$, where x varies from about 1 to about 2, y varies from about 1 to about 4, and z varies from about 2 to about 8, formed by chemically converting a portion of the substrate surface such that the empirical formula of the coating varies within the coating.

18. The engine component of claim 17, wherein a thickness of the coating is from about 5 microns to about 10 microns.

19. The engine component of claim 17, further including an adhesion layer between the substrate and the coating.

20. The engine component of claim 17, wherein the coating is a conformal coating.

* * * * *